US006498555B1

(12) United States Patent
Sakata

(10) Patent No.: US 6,498,555 B1
(45) Date of Patent: Dec. 24, 2002

(54) MONOLITHIC INDUCTOR

(75) Inventor: Keiji Sakata, Sabac (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/627,777

(22) Filed: Jul. 28, 2000

(30) Foreign Application Priority Data

Jul. 30, 1999 (JP) ..... 11-216620

(51) Int. Cl.[7] ..... H01F 5/00
(52) U.S. Cl. ..... 336/200; 336/83
(58) Field of Search ..... 336/83, 200, 223, 336/232, 192; 29/602.1; 257/531

(56) References Cited

FOREIGN PATENT DOCUMENTS

| | | | |
|---|---|---|---|
| JP | 58-67007 | * | 4/1983 |
| JP | 5-205943 | * | 8/1993 |
| JP | 5-66920 | | 9/1993 |
| JP | 6-20839 | | 1/1994 |
| JP | 8-186024 | | 7/1996 |
| JP | 11-45809 | | 2/1999 |

* cited by examiner

*Primary Examiner*—Lincoln Donovan
*Assistant Examiner*—Tuyen T. Nguyen
(74) *Attorney, Agent, or Firm*—Keating & Bennett, LLP

(57) ABSTRACT

In a monolithic inductor wherein a coil conductor section of at least one turn at a certain height is formed, and a plurality of coil conductor sections are electrically connected via a via-hole electrode, a structure that can increase the inductance obtaining efficiency is provided. The monolithic inductor comprising a coil conducting section of at least one turn at a certain height of the sintered ceramic body formed of magnetic ceramics, wherein a coil is formed by electrically connecting a plurality of coil conductor sections via a via-hole electrode, and the terminal end of the upper coil conductor section and the beginning end of the lower coil conductor section are bent inwardly of the coil when viewed from the top so that the inner connecting portion of the coil where the upper and lower coil conductor sections are electrically connected via a via-hole electrode is situated within the coil composed of the upper and lower coil conductor sections.

9 Claims, 10 Drawing Sheets

MONOLITHIC INDUCTOR

BACKGROUND OF THE INVENTION

1. Field of the Invention

The present invention relates to a monolithic inductor used as, for example, an inductor or coil and, more specifically, the present invention relates to a monolithic inductor having a greatly improved connecting structure between coil conductors in a sintered ceramic body.

2. Description of the Related Art

Various monolithic inductors having a coil conductor embedded in magnetic ceramics are known (See for example, Japanese Patent No. 2655657, Japanese Unexamined Patent Application Publication No. 62-189707, Japanese Unexamined Patent Application Publication No. 59-152605).

Such a conventional monolithic inductor is manufactured by printing a conductor pattern on a ceramic green sheet which is composed almost exclusively of magnetic ceramics, laminating a plurality of such ceramic green sheets, and sintering the ceramic green sheets as a unit to obtain a sintered ceramic body, whereby a plurality of conductor patterns printed on a plurality of ceramic green sheets are connected through via-hole electrodes so that a coil is constructed in a sintered ceramic body.

FIGS. 6 to 9 are explanatory schematic plan views of the above described conductor pattern in a conventional monolithic inductor. While there are shown only the coil conductor sections in FIGS. 6 to 9, a coil conductor section is printed on each ceramic green sheet by screen printing or other suitable process.

In a structure shown in FIG. 6, several ¾-turn coil conductor sections 51–53 are electrically connected via electrodes 54 and 55. Each coil conductor section 51 to 53 is printed on the respective ceramic green sheet and has a ¾-turn. In other words, when viewed from the top, it appears to be a coil having a rectangular shape, however the coil conductor sections 51–53 each constituting a ¾-turn of a rectangular coil are printed on the respective ceramic green sheets.

In a structure shown in FIG. 7, the coil conductor sections 56–58 are connected through via-hole electrodes 59 and 60. Each of the coil conductor sections 56–58 constitutes a turn of a rectangular coil.

In a structure shown in FIG. 8, the coil conductor sections 61 and 62 are electrically connected through a via-hole electrode 63. Each of the coil conductor sections 61 and 62 constitutes 2.25 turns of a coil composed of coil conductors.

In a structure shown in FIG. 9, the coil conductor sections 64, 65 are connected through a via-hole electrode 66. Each of the coil conductor sections 64 and 65 constitutes 2.25 turns of a coil composed of coil conductors.

In the coil conductor sections 64 and 65 shown in FIG. 9, by increasing the number of turns of a coil conductor section printed on a green sheet, miniaturization of a monolithic inductor may be realized.

As described above, by increasing the number of turns of each coil conductor section to be printed on each ceramic green sheet, miniaturization of a monolithic inductor may be achieved. However, there is a recognized disadvantage that if a coil conductor section of more than one turn is formed on a ceramic green sheet as in the structures shown in FIGS. 7 to 9, even if the number of turns is increased, a large inductance corresponding to the increased turns cannot be obtained. This will be explained referring to FIG. 10 and FIG. 11.

FIG. 10A is a cross-sectional view illustrating a portion of a monolithic inductor having coil conductor sections 56–58 of FIG. 7 taken along the line A—A in FIG. 7. In the monolithic inductor 71, upper and lower coil conductor sections, that is, the coil conductor section 56 and the coil inductor section 57, for example, are arranged in such a manner that the upper and lower coil conductor sections 56 and 57 overlap one on another in the direction of thickness via a ceramic layer on the side opposed to the side where the via-hole electrodes are provided. However, in the vicinity of the portion where the via-hole 59 is provided, in other words, in the vicinity of the extremity 56*a* of the coil conductor section 56 and the extremity 57*a* of the coil conductor section 57, as will be apparent from FIG. 10A and FIG. 7, the upper and lower coil conductor sections 56 and 57 do not overlap one another in the direction of thickness.

Likewise, FIG. 10B is a cross-sectional view illustrating a monolithic inductor having coil conductor sections 61 and 62 of FIG. 8 taken along the line B—B of FIG. 8. In this case as well, in the vicinity of the extremity 61*a* of the coil conductor section 61 and in the vicinity of the extremity 62*a* of the coil conductor section 62, the upper and lower coil conductor sections 61 and 62 do not overlap one another in the direction of thickness and are not aligned.

FIGS. 11A and 11B are cross-sectional views illustrating the monolithic inductor using the coil conductor sections 64 and 65 of FIG. 9 taken along the lines C—C and D—D of FIG. 9 respectively. When the coil conductor sections 64 and 65 of 2.25 turns are laminated alternately, non-alignment portions between the upper and lower coil conductor sections 64 and 65 are present in the vicinity of the extremity 64*a* of the coil conductor section 64 and in the vicinity of the beginning end 65*a* of the coil conductor section 65.

In other words, while the upper and lower coil conductor sections 51–53 can be overlapped precisely on one another in the case of coil conductor sections 51 to 53 of ¾-turn shown in FIG. 6, there is a portion where the upper and lower coil conductor do not align in the direction of thickness when the number of turns is increased. When the portion where the upper and lower coil conductor sections are not aligned via the ceramic layer in the direction of thickness is formed, the magnetic path in that portion is hindered, thus lowering the efficiency of inductance which is obtained by the inductor component. Since the coil conductor sections shown in FIG. 6 are ¾-turn sections, when these coil conductor sections are laminated, the distances between the coil conductor sections in the direction of lamination becomes wider in some portions. As a result, deterioration of the characteristics associated with the leakage of magnetic flux occurs.

SUMMARY OF THE INVENTION

In order to overcome the problems described above, preferred embodiments of the present invention provide a monolithic inductor wherein the formation of portions where the upper and lower coil conductor sections do not overlap on one another is reduced even when the number of turns of a coil conductor section provided on a ceramic green sheet is selected to be 1 or more to achieve miniaturization, and thereby a large inductance is obtained.

According to one preferred embodiment of the present invention, a monolithic inductor includes a sintered ceramic body, and a plurality of coil conductor sections in which each coil conductor is wound by at least one turn, wherein the plurality of the coil conductor sections are located at vertical positions in the sintered ceramic body, and the upper and lower conductor sections are electrically connected through via-hole electrodes to define a coil, a terminal end of the upper coil conductor section and a beginning end of the lower coil conductor section are bent inwardly from the innermost portion of the coil such that a connecting portion of the coil where the upper and lower coil conductor sections are electrically connected through a via-hole electrode is located within the innermost portion of the coil defined by the upper and lower coil conductor sections.

According to at least one preferred embodiment of the present invention, a coil is preferably a substantially rectangular coil in a plan view, and the terminal end of the upper coil conductor section and the beginning end of the lower coil conductor sections are respectively bent in a direction that is substantially perpendicular to the innermost substantially rectangular coil portion.

According to another preferred embodiment of the present invention, in the outer connecting portion of the coil where the upper and lower coil conductor sections are electrically connected, a terminal end of another upper coil conductor section and a beginning end of another lower coil conductor section are electrically connected through a via-hole electrode in the outermost portion of the coil.

According to further preferred embodiment of the present invention, the sintered ceramic is an integrally sintered ceramic body which is formed preferably by laminating and sintering a plurality of ceramic green sheets each having a coil conductor section of at least one turn printed thereon.

Other characteristics, features, elements and advantages of the present invention will become apparent from the following detailed description of the preferred embodiments thereof with reference to the attached drawings.

DETAILED DESCRIPTION OF PREFERRED EMBODIMENTS

Figure 1:
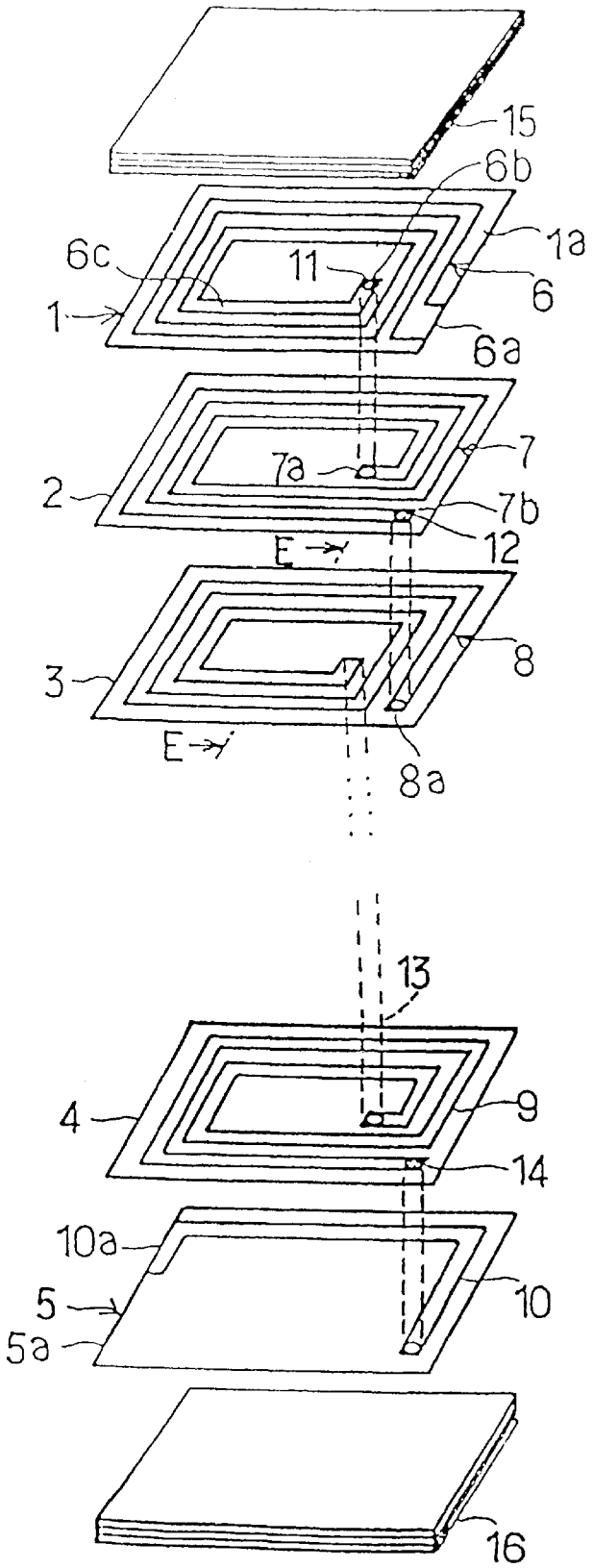
FIG. 1 is an explanatory exploded perspective view illustrating a manufacturing method and a structure of a monolithic inductor according to the first preferred embodiment of the present invention.
Figure 2:
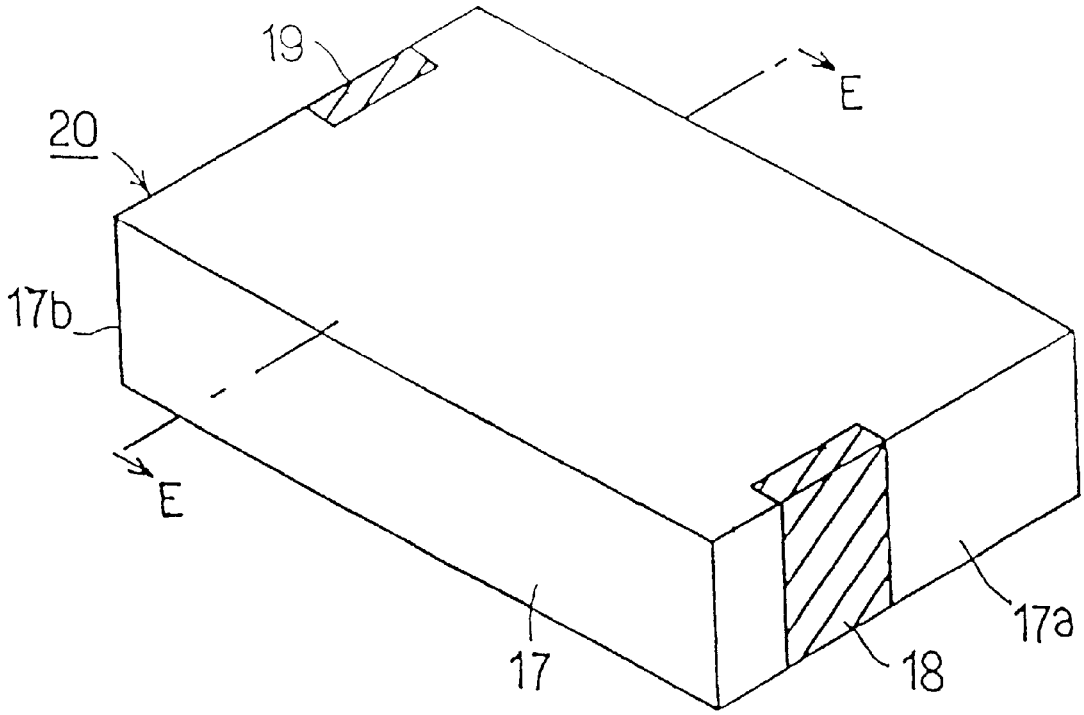
FIG. 2 is a perspective view illustrating the appearance of the monolithic inductor according to the first preferred embodiment of the present invention.

Referring now to various preferred embodiments of the present invention, the present invention will be described in detail. FIG. 1 is an explanatory exploded perspective view illustrating a manufacturing method and an internal structure of a monolithic inductor according to the first preferred embodiment of the present invention, and FIG. 2 is a perspective view illustrating the appearance thereof.

In order to obtain the monolithic inductor of this preferred embodiment, as a first step, ceramic slurry made mainly of magnetic ceramic such as ferrite or other suitable material is molded into sheets to obtain preferably substantially rectangular ceramic green sheets.

As a next step, the coil conductor sections 6–10 are provided on the green sheets 1–5 prepared in the previous step. The coil conductor sections 6–10 are preferably produced by screen printing of conductive paste but may be produced by other suitable methods. For example, the coil conductor sections 6–10 may be formed by a thin film forming method such as deposition.

On the green sheets 1–4, via-hole electrodes 11–14 are arranged to electrically connect the upper and the lower coil conductor sections. The via-hole electrodes 11–14 are provided by forming through holes on the ceramic green sheets 1–4 and filling the conductive paste in the through holes. The via-hole electrodes 11–14 may be defined by applying a conductive material into the through hole by other methods.

In this preferred embodiment, the coil conductor sections 6–10 are electrically connected through the via-hole electrodes 11–14 and a coil having a substantially rectangular frame in a plan view is provided. In FIG. 1, though the portion between the coil conductor section 8 and the coil conductor section 9 is not shown, a coil conductor of a desired length may be defined by laminating the coil conductor sections 6, 7, and 8 repeatedly.

The beginning end 6*a* of the uppermost coil conductor section 6 extends to the edge 1*a* of the ceramic green sheet 1. The terminal end 10*a* of the lowermost coil conductor section 10 extends to the edge 5*a* of the ceramic green sheet 5.

The monolithic body is obtained by laminating the above described ceramic green sheets 1–10 and laminating a predetermined number of ceramic green sheets 15, 16 with no pattern thereon on the upper portion and the lower portion. The sintered ceramic body 17 shown in FIG. 2 is obtained by pressurizing the laminated elements of the monolithic body in the thickness direction thereof and sintering the monolithic body. Then, the monolithic inductor 20 of this preferred embodiment is completed by providing the external electrodes 18 and 19 on the opposed end surfaces 17*a* and 17*b*.

The external electrodes 18 and 19 are electrically connected to the beginning end 6*a* of the coil conductor section 6 described above and the terminal end 10*a* of the coil conductor section 10. Therefore, the coil is electrically connected between the external electrodes 18 and 19.

The monolithic inductor 20 of this preferred embodiment has a unique connecting structure between the upper and lower conductor sections. This will be described by referring to the coil conductor sections 6–8. The coil conductor section 6 defines two turns of the coil. In other words, the coil conductor section 6 is constructed such that two turns of a substantially rectangular coil is extended from the beginning end 6*a* to the terminal end 6*b*, and a via-hole electrode 11 is provided in the vicinity of its terminal end 6*b*. In this case, in the coil conductor section 6, the portion in the vicinity of the terminal end 6*b* is extended in the direction that is substantially perpendicular to the portion of the coil 6*c* which is continuously connected to the portion in the vicinity of the terminal end 6*b* of the coil conductor section 6, and is extended inwardly of the substantially rectangular coil in the plan view.

On the other side, regarding the coil conductor section 7, the portion in the vicinity of the beginning end 7*a* is electrically connected to the via-hole electrode 11. The portion in the vicinity of the beginning end 7*a* is extended inwardly of the portion of the substantially rectangular coil that is continuously connected to the beginning end 7*a* in the direction that is substantially perpendicular thereto.

In other words, in a plan view of the coil defined by connecting the coil conductor 6 and the coil conductor 7 through the via-hole electrode 11, the terminal end 6*b* of the coil conductor 6 and the beginning end 7*a* of the coil conductor 7 are respectively bent inwardly of the innermost substantially rectangular coil portion in the direction orthogonal thereto. Therefore, the connecting portion connected via the electrode 11 is located within the innermost turn of the substantially rectangular coil.

Figure 3A:
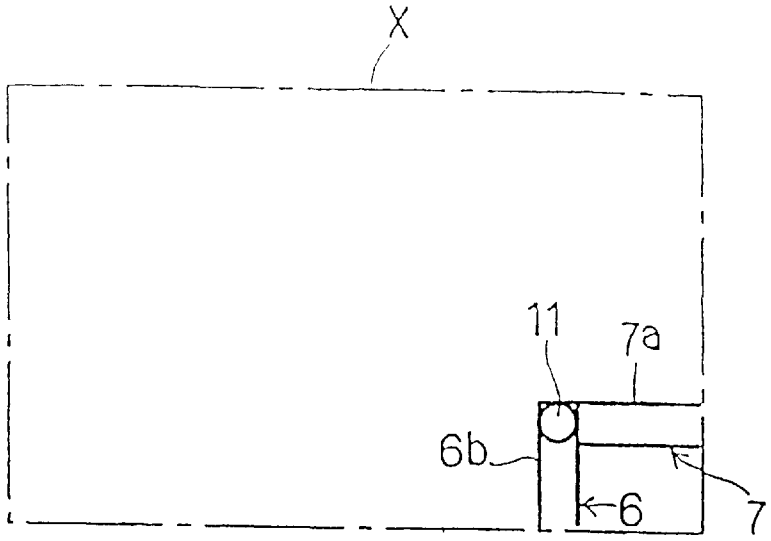
FIG. 3A is a plan view in schematic form illustrating the relationship between the connecting portions of the upper and the lower coil conductor sections and the coil in the monolithic inductor of the first preferred embodiment of the present invention.

That is to say, as shown in the schematic plan view of FIG. 3A, in the substantially rectangular coil X including the coil conductor sections 6 and 7, the terminal end 6*b* of the coil conductor section 6 and the beginning end 7*a* of the coil conductor section 7 are bent inwardly of the coil portion such that the terminal end 6*b* of the upper coil conductor section 6 and the beginning end 7*a* of the lower coil conductor section 7 are located within the coil X.

Figure 3B:
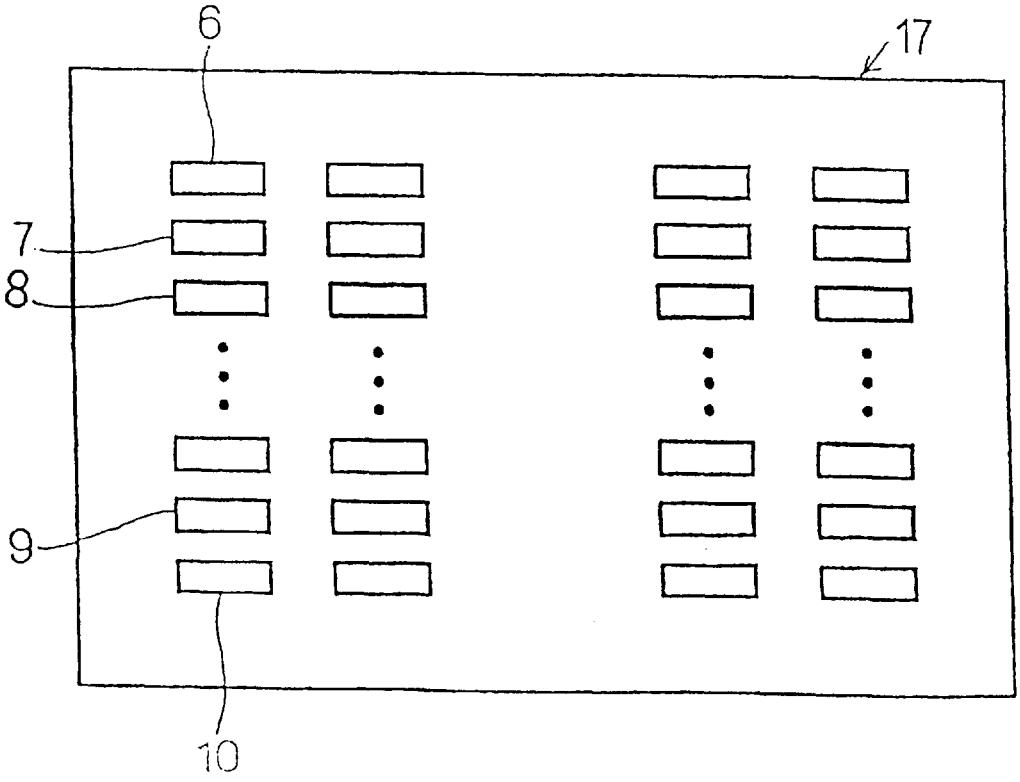
FIG. 3B is a cross-sectional view taken along line E—E of FIG. 1 and FIG. 2 of the monolithic inductor of the first preferred embodiment of the present invention.

In other words, according to the monolithic inductor 20 of the present preferred embodiment since the terminal end of the upper coil conductor section and the beginning end of the lower conductor section are respectively bent inwardly of the substantially rectangular coil at the portion where the upper and the lower coil conductor sections are connected within the coil, the upper and the lower coil conductor sections overlap each another in the direction of thickness via a ceramic layer, as shown in a cross-sectional view of FIG. 3B taken along the line E—E of FIG. 1. Therefore, the portions where the upper and lower coil inductor sections do not overlap each other are reduced to a significant extent, and thus, the efficiency of inductance obtained thereby is greatly increased.

At the portion where the upper and lower conductor are electrically connected through a via-hole electrode on the outer portion of the coil, the terminal end of the upper coil conductor and the beginning end of the lower coil conductor are electrically connected through the via-hole electrode on the coil when viewed from the top of the coil. For example, the terminal end 7*b* of the coil conductor section 7 and the beginning end 8*a* of the coil conductor section 8 are connected through a via-hole electrode 12 on the coil.

Figure 4:
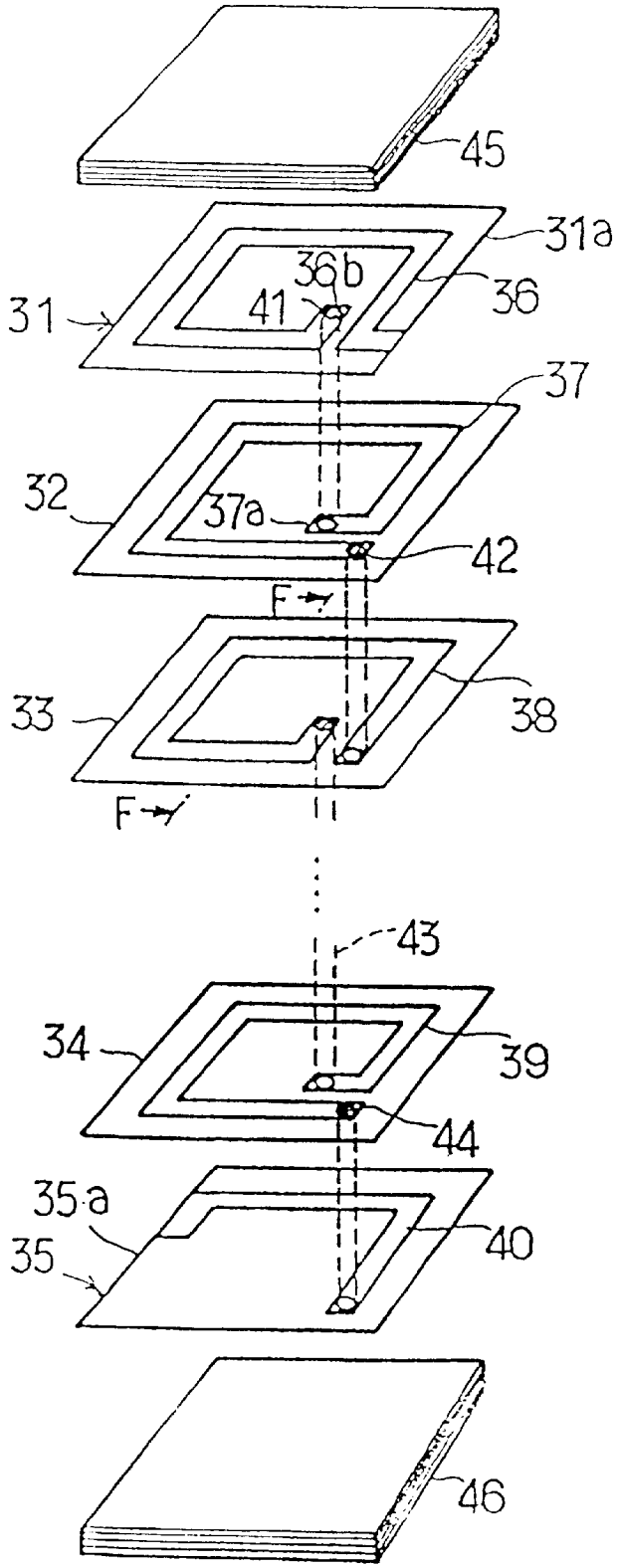
FIG. 4 is an explanatory exploded perspective view illustrating a manufacturing method and a structure of a monolithic inductor according to the second preferred embodiment of the present invention.

FIG. 4 is an explanatory exploded perspective view of the monolithic inductor according to the second preferred embodiment of the present invention, which corresponds to FIG. 1 of the first preferred embodiment. In the monolithic inductor according to the second preferred embodiment, the magnetic green sheets 31–35 formed by molding ceramic slurry of mainly ferrite powder into the shape of sheets are laminated. On the upper surfaces of the green sheets 31–35, the coil conductor sections 36–40 are provided, respectively. The coil conductor sections 36–40 are electrically connected to each other through via-hole electrodes 41–44. Therefore, a coil conductor includes a coil having a substantially rectangular spiral shape and having coil conductor sections 36–40 electrically connected with each other through via-hole electrodes 41–44.

The uppermost coil conductor section 36 extends to the edge 31*a* of the green sheet 31, and the terminal end of the lowermost coil conductor section 40 extends to the edge 35a of the green sheet 35. These portions extending to the edges of the coil conductor sections 36, 40 are connected to the external electrodes provided on the outer surfaces of the sintered ceramic body as in the first preferred embodiment.

On the upper and lower sides of the green sheets 31–35, a predetermined number of magnetic green sheets 45 and 46 with no pattern thereon are laminated. In this preferred embodiment as well, the sintered ceramic body is obtained by sintering a monolithic body defined by laminating the above described green sheets 31–35 and the green sheets 45 and 46, and pressurizing the monolithic body in the direction of the thickness thereof. Then a pair of external electrodes as in the first preferred embodiment are provided, and the monolithic inductor is completed.

In this preferred embodiment, each of the coil conductor sections 36–39 defines a turn in the substantially rectangular spiral coil. Regarding the coil conductor sections 36 and 37, the terminal end 36*b* of the coil conductor section 36 and the beginning end 37*a* of the coil conductor section 37 are bent inwardly from the substantially rectangular coil portion in a direction that is substantially perpendicular thereto such that the portion where the terminal end 36*b* of the upper coil conductor section 36 and the beginning end 37*a* of the lower coil conductor section 37 are electrically connected through a via-hole electrode 41 is located inside the substantially rectangular coil portion defined by the coil conductor sections 36 and 37.

Figure 5:
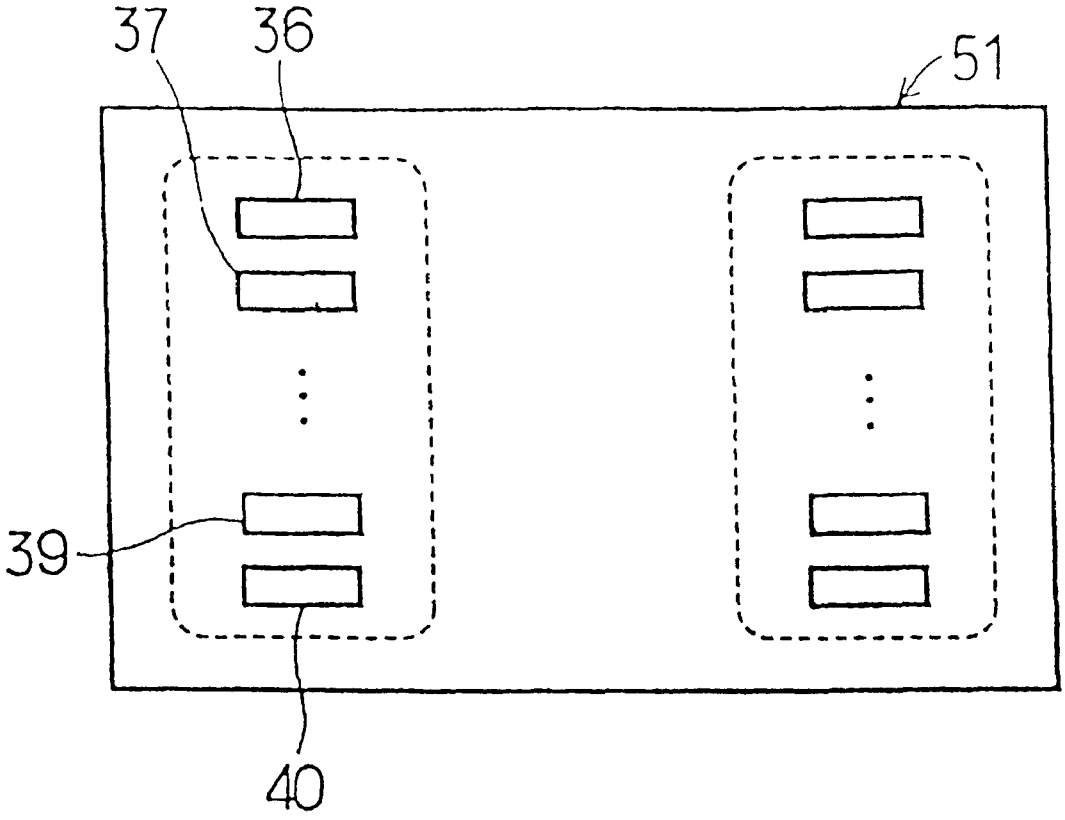
FIG. 5 is a cross-sectional view taken along line F—F of FIG. 4 illustrating the second preferred embodiment.
Figure 6:
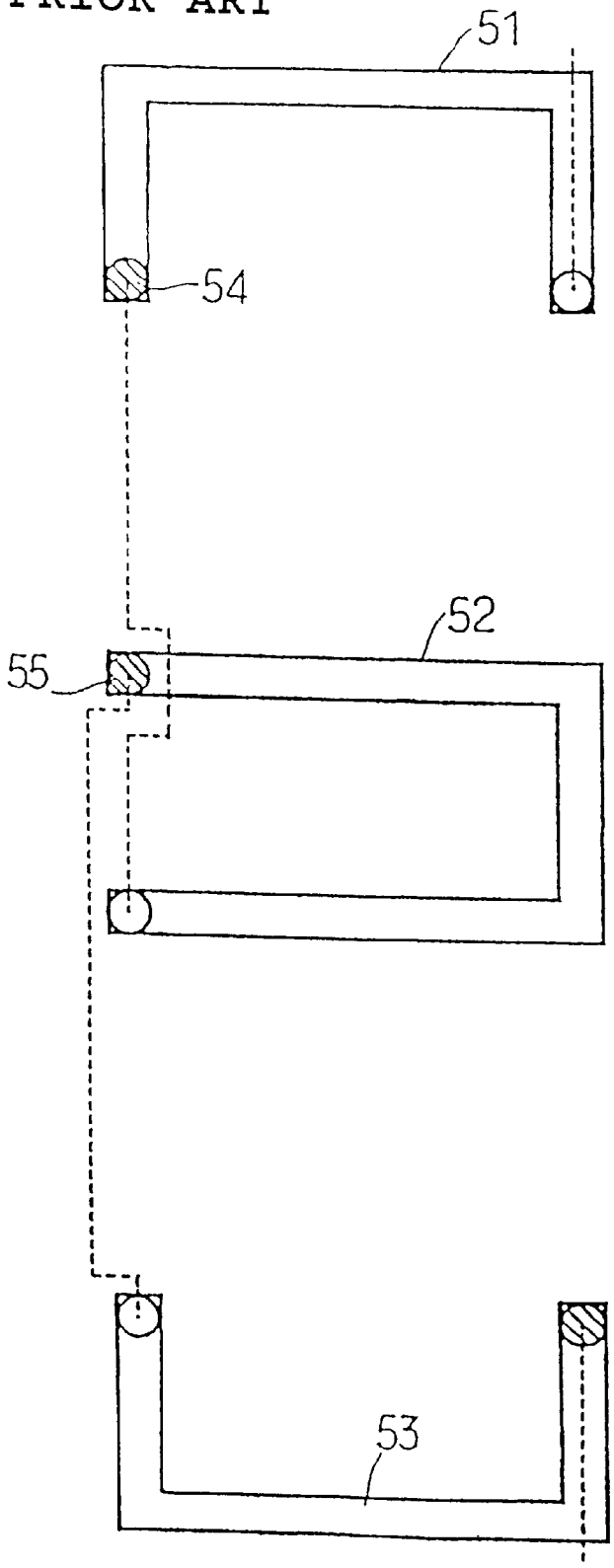
Fig 6 PRIOR ART
FIG. 6 is an explanatory plan view in a schematic form illustrating the first example of the conventional monolithic inductor.
Figure 7:
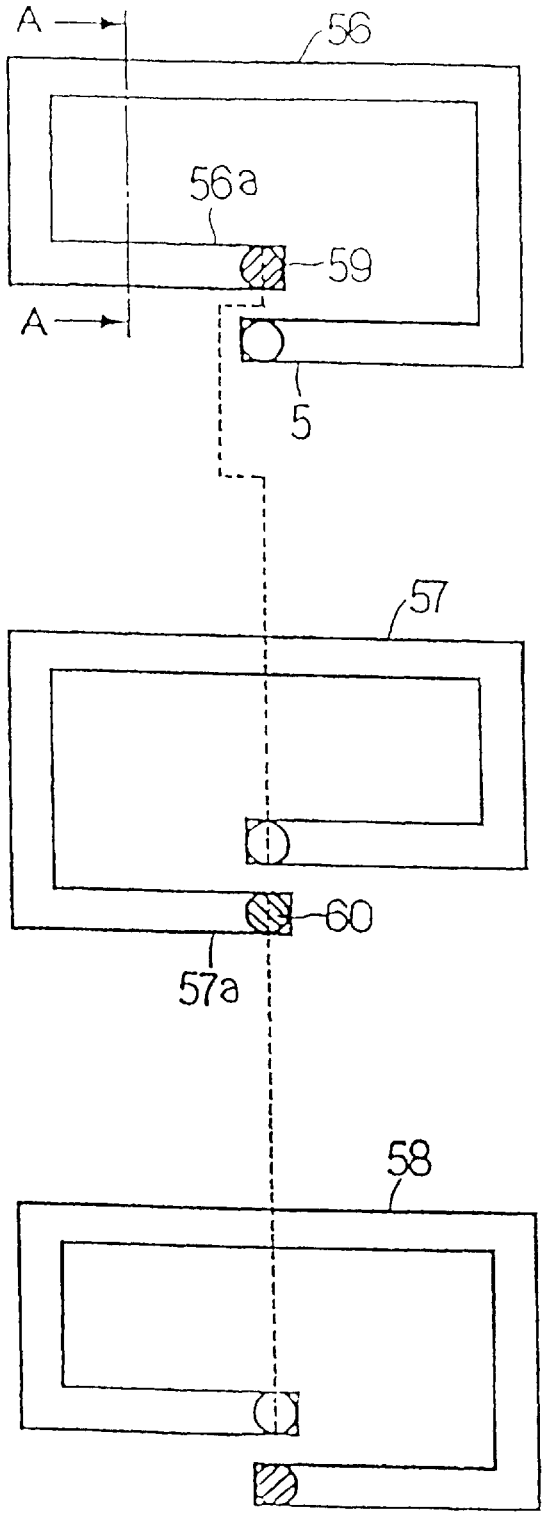
Fig. 7 PRIOR ART
FIG. 7 is an explanatory plan view in a schematic form illustrating the second example of the conventional monolithic inductor.
Figure 8:
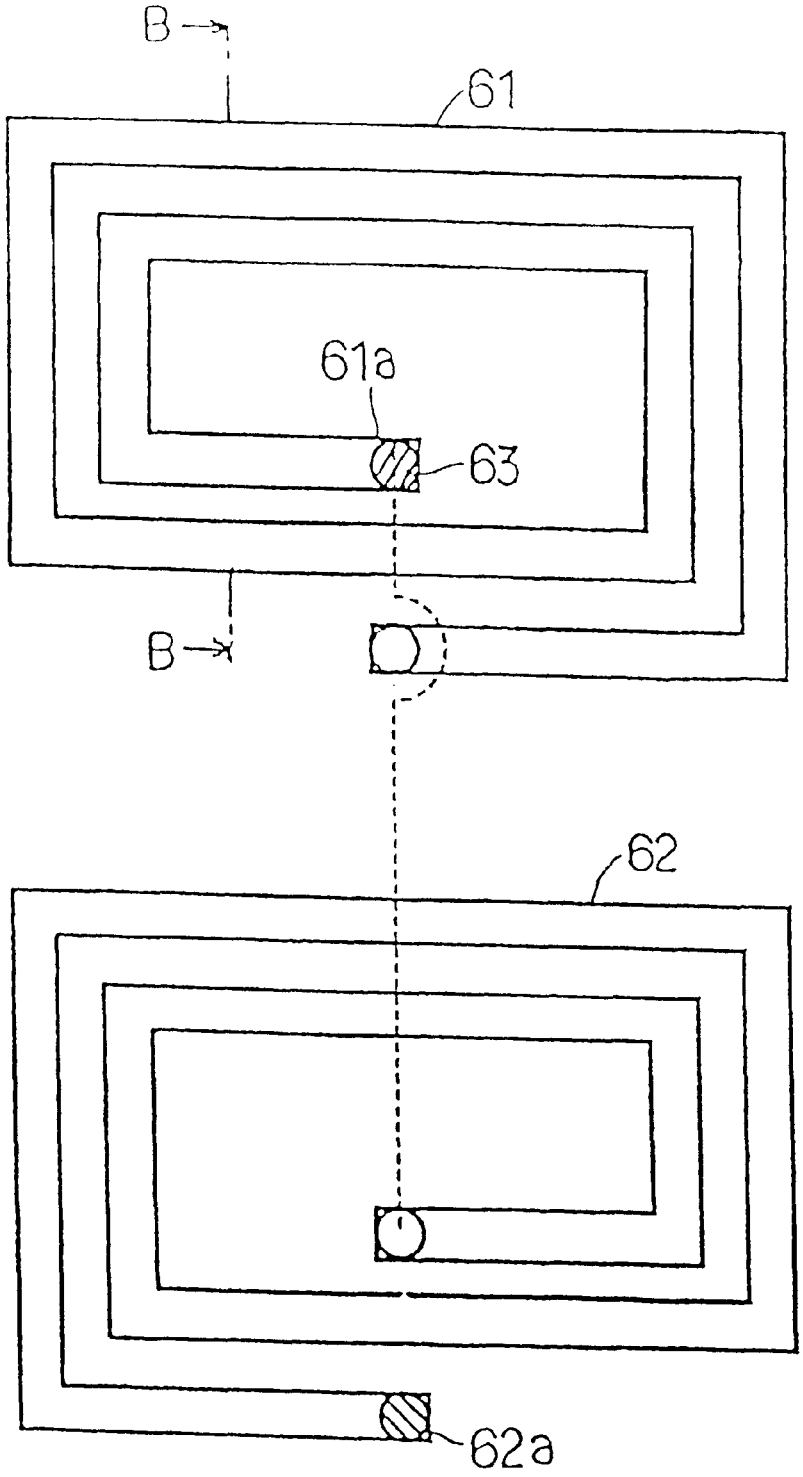
Fig. 8 PRIOR ART
FIG. 8 is an explanatory plan view in a schematic form illustrating the third example of the conventional monolithic inductor.
Figure 9:
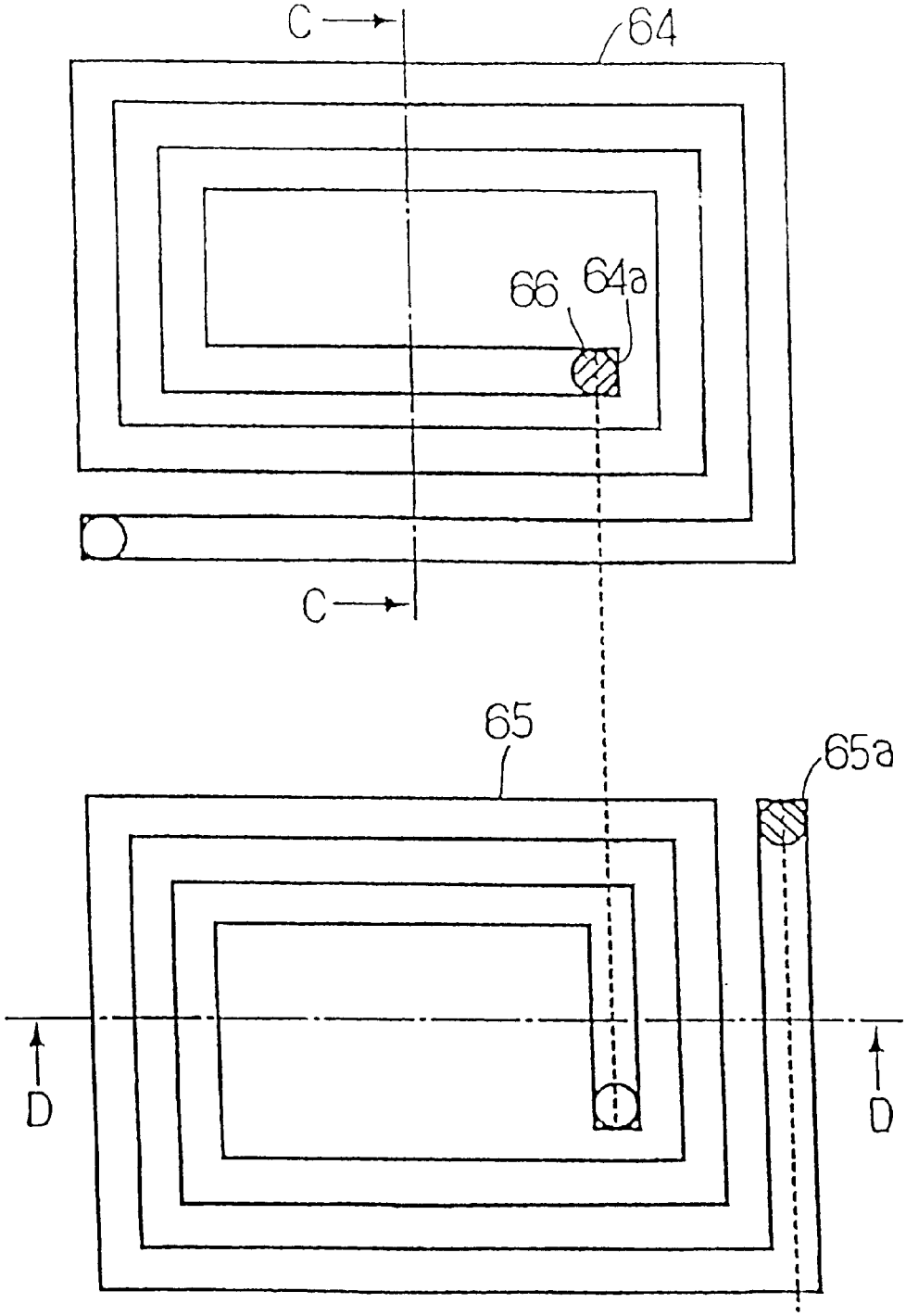
Fig. 9 PRIOR ART
FIG. 9 is an explanatory plan view in a schematic form illustrating the fourth example of the conventional monolithic inductor.
Figure 10A:
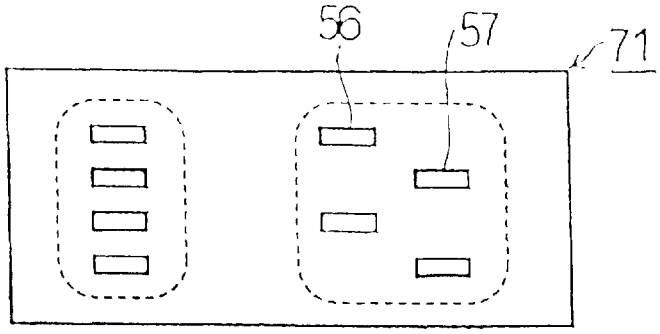
Fig. 10A PRIOR ART
FIGS. 10A and 10B are cross-sectional views illustrating monolithic inductors having the coil conductor sections shown in FIG. 7 and FIG. 8, respectively.
Figure 10B:
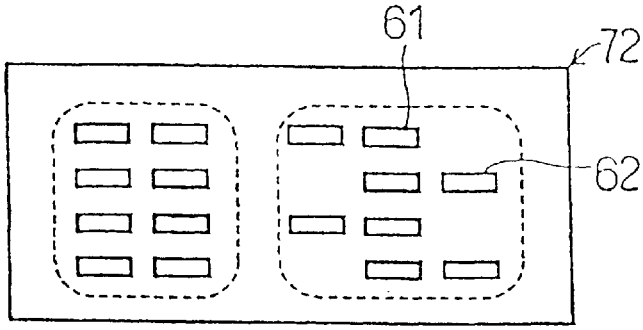
Fig. 10B PRIOR ART
Figure 11A:
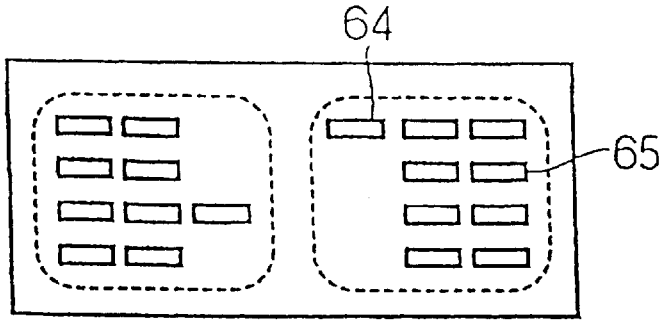
Fig. 11A PRIOR ART
FIGS. 11A and 11B are cross-sectional views illustrating monolithic inductors having the coil conductor sections shown in FIG. 8 and FIG. 9 respectively.
Figure 11B:
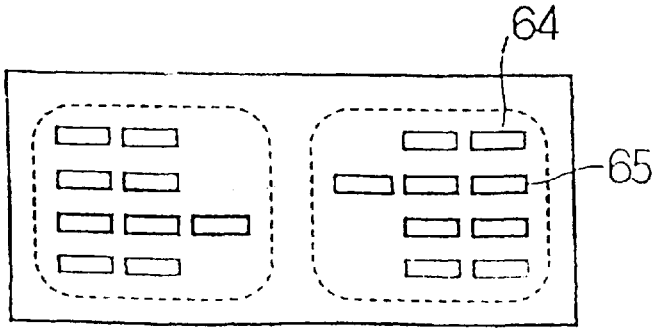
Fig. 11B PRIOR ART

While the connection structure between the coil conductor section 36 and the coil conductor section 37 has been described so far, the connection structure between the coil conductor sections 38 and 39 is also preferably the same. A connecting portion in which the coil conductor sections 37 and 38 are connected through a via-hole electrode 42 is disposed on the coil having the substantially rectangular spiral shape. Therefore, in the monolithic inductor of various preferred embodiments of the present embodiment, as shown in FIG. 5 which is taken along the line F—F of FIG. 4, the upper and lower coil conductor sections overlap one another via ceramic layers in between. As a result, displacement of the upper and lower coil conductor sections from the properly overlapped position in the portion where the coil is arranged is reliably prevented. Therefore, the efficiency of obtaining inductance of the monolithic inductor 51 is also greatly increased effectively as in the first preferred embodiment.

In the second preferred embodiment, since a turn of the coil conductor section is provided on a green sheet, this turn of the substantially rectangular coil corresponds to "the innermost substantially rectangular coil" of the present invention. When the number of turns arranged on one sheet is more than one as in the first preferred embodiment, the coil having a substantially rectangular spiral shape is provided. In that case, the connecting portion between the upper and lower coil conductor sections is located within the innermost portion of the substantially rectangular coil.

While in the first and second preferred embodiments, two turns and one turn of coil conductor sections are provided on one green sheet, respectively, the number of turns of the coil conductor sections provided in a sintered ceramic body at a certain vertical position or height, or provided per green sheet, may be changed as long as it is at least one turn.

While in the first and second preferred embodiments, the terminal end of the upper coil conductor section and the beginning end of the lower coil conductor section are bent in the direction that is substantially perpendicular to the coil portion, respectively so that the portion electrically connecting the upper and the lower coil conductor sections through a via-hole electrode is located within the innermost portion of the coil defined by the upper and the lower coil conductor sections. However, it may not be substantially perpendicular necessarily as far as it is located within the innermost portion of the coil. Since the coil itself has a substantially rectangular shape in the present preferred embodiments, it is more convenient to form the terminal end of the upper coil conductor section and the beginning end of the lower coil conductor section in the direction that is substantially perpendicular to the coil in the shape of a substantially rectangular frame when printing the coil conductor section.

The sintered ceramic body does not have to be formed of magnetic ceramics necessarily, and for example, insulating ceramics may also be used.

When viewed from the top of the monolithic inductor according to various preferred embodiments of the present invention, in the inner side of the substantially rectangular coil, the terminal end of the upper coil conductor and the beginning end of the lower coil conductor are bent inwardly of the substantially rectangular coil respectively so that the portion where the upper and the lower coil conductor sections are electrically connected via a via-hole electrode is located within the coil defined by the upper and the lower conductor sections. Therefore, even when the coil conductor section coiled at least one turn is used in the sintered ceramic body at a certain vertical position for achieving miniaturization, the inductance obtaining efficiency may be increased effectively and widening of the distance between superimposed coil conductor sections may be prevented so that the deterioration of the characteristic due to the occurrence of leakage flux is reliably prevented. Therefore, a compact monolithic inductor having a large inductance may be reliably provided.

In various preferred embodiments of the present invention, when the coil is substantially rectangular in shape, and when the terminal end of the upper coil conductor section and the beginning end of the lower coil conductor section are bent in the direction that is substantially perpendicular to the portion of the coil connected thereto, the terminal end of the upper coil conductor section and the beginning end of the lower coil conductor section may be constructed easily by, for example, screen printing since the coil is substantially rectangular in shape as a whole.

In the portion where the upper and the lower coil conductor sections are electrically connected through a via-hole at the outer portion of the coil, in the case where the terminal end of the upper coil conductor section and the beginning end of the lower coil conductor section are electrically connected through a via-hole electrode on the outermost portion of the coil when viewed from the top of the coil, the outer connecting portion of the coil between the upper and the lower coil conductor section is located on the coil, and therefore it is assured that the upper and lower coil conductor sections are able to be overlapped so that the outer connecting portions can be situated on one another.

In the case where a unitary sintered ceramic body obtained by laminating a plurality of ceramic green sheet each having a coil conductor section of more than one turn is used as a sintered ceramic body, the monolithic inductor according to various preferred embodiments of the present invention may be provided easily and steadily according to the well known method for manufacturing monolithic ceramic electronic components.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. A monolithic inductor comprising:

a sintered ceramic body; and a plurality of coil conductor sections including a plurality of coil conductors, each of which is wound by at least one full turn;

wherein the plurality of the coil conductor sections are located at different vertical positions in said sintered ceramic body, and upper and lower coil conductor sections are electrically connected through via-hole electrodes to define a coil having an innermost portion and an outermost portion, a terminal end of the upper coil conductor section and a beginning end of the lower coil conductor section are bent inwardly from the innermost portion of the coil such that a connecting portion of the coil defined by the terminal end of the upper coil conductor section, the beginning end of the lower coil conductor section and one of the via-hole electrodes provided to connect the terminal end of the upper coil conductor section and the beginning end of the lower coil conductor section is located within and spaced inwardly from the innermost portion of the coil defined by the upper and lower coil conductor sections, and the terminal end of the upper coil conductor section and the beginning end of the lower coil conductor section are not aligned and do not overlap one another along respective lengths thereof; and substantially all portions of said upper coil conductor section are aligned with and overlap substantially all portions of said lower coil conductor section in the vertical direction of said sintered ceramic body.

2. The monolithic inductor as set forth in claim 1, wherein said coil is a substantially rectangular coil, and the terminal end of said upper coil conductor section and the beginning end of said lower coil conductor sections are respectively bent in a direction that is substantially perpendicular to the innermost coil portion.

3. The monolithic inductor as set forth in claim 2, wherein in an outer connecting portion of the coil where the upper and lower coil conductor sections are electrically connected, a terminal end of another upper coil conductor section and a beginning end of another lower coil conductor section are electrically connected through a via-hole electrode in an outermost portion of the coil.

4. The monolithic inductor as set forth in claim 1, wherein said sintered ceramic is an integrally sintered ceramic body including a plurality of laminated and sintered ceramic green sheets each having a coil conductor section of at least one turn provided thereon.

5. The monolithic inductor as set forth in claim 3, wherein said sintered ceramic is an integrally sintered ceramic body including a plurality of laminated and sintered ceramic green sheets each having a coil conductor section of at least one turn provided thereon.

6. The monolithic inductor as set forth in claim 2, wherein each of said plurality of coil conductors is wound by approximately two full turns.

7. The monolithic inductor as set forth in claim 6, wherein one of said via-hole electrodes is provided in the vicinity of the terminal end.

8. The monolithic inductor as set forth in claim 2, wherein the connecting portion connected via the electrode is located within the innermost turn of the substantially rectangular coil.

9. The monolithic inductor as set forth in claim 1, wherein said coil has a substantially rectangular spiral shape.

* * * * *